US008677904B2

(12) United States Patent
Rexford et al.

(10) Patent No.: US 8,677,904 B2
(45) Date of Patent: Mar. 25, 2014

(54) TRICOLOR FLARE PROJECTILE

(76) Inventors: Matthew D. Rexford, Tallahassee, FL (US); David R. Grymonpre, Tallahassee, FL (US); James P. Muncie, Tallahassee, FL (US); Dale P. Krejcar, Jr., Perry, FL (US); Gilbert D. Rykard, Jr., Perry, FL (US)

( * ) Notice: Subject to any disclaimer, the term of this patent is extended or adjusted under 35 U.S.C. 154(b) by 0 days.

(21) Appl. No.: 13/211,546

(22) Filed: Aug. 17, 2011

(65) Prior Publication Data

US 2013/0042781 A1 Feb. 21, 2013

(51) Int. Cl.
*F42B 4/26* (2006.01)

(52) U.S. Cl.
USPC ..... 102/345; 102/342; 102/360; 102/361

(58) Field of Classification Search
USPC ..... 102/336, 337, 338, 345, 335, 342, 360, 102/341, 357, 347, 351, 352, 361
See application file for complete search history.

(56) References Cited

U.S. PATENT DOCUMENTS

| | | | | | |
|---|---|---|---|---|---|
| 197,339 | A | * | 11/1877 | Coston | 102/346 |
| 511,644 | A | * | 12/1893 | Nelson | 102/361 |
| 617,539 | A | * | 1/1899 | Pain | 102/337 |
| 624,530 | A | * | 5/1899 | Pain | 102/360 |
| 630,477 | A | | 8/1899 | Behr | |
| 1,366,555 | A | * | 1/1921 | Brayton | 102/345 |
| 3,062,144 | A | * | 11/1962 | Hori et al. | 102/430 |
| 3,143,965 | A | * | 8/1964 | La Pointe | 102/351 |
| 3,262,824 | A | | 7/1966 | McGriffin | |
| 3,490,966 | A | | 1/1970 | Hiltz | |
| 3,566,791 | A | * | 3/1971 | Lohkamp | 102/345 |
| 3,713,636 | A | * | 1/1973 | Helms et al. | 266/71 |
| 3,951,705 | A | | 4/1976 | Mancinelli | |
| 4,593,622 | A | * | 6/1986 | Fibranz | 102/530 |
| 4,651,648 | A | * | 3/1987 | Alon | 102/387 |
| 4,791,870 | A | * | 12/1988 | Simpson | 102/342 |
| 5,983,801 | A | * | 11/1999 | Brunn | 102/334 |
| 6,283,033 | B1 | * | 9/2001 | Wu et al. | 102/352 |
| 6,513,438 | B1 | * | 2/2003 | Fegg et al. | 102/336 |
| RE38,592 | E | * | 9/2004 | Wu et al. | 102/352 |
| 7,025,001 | B2 | * | 4/2006 | Brunn | 102/502 |
| 7,421,950 | B2 | * | 9/2008 | Dillard et al. | 102/345 |
| 7,908,972 | B2 | | 3/2011 | Brunn | |
| 7,992,496 | B2 | * | 8/2011 | Dillard et al. | 102/342 |
| 8,276,518 | B2 | * | 10/2012 | Dillard et al. | 102/342 |
| 2004/0011235 | A1 | * | 1/2004 | Callaway et al. | 102/336 |
| 2007/0039505 | A1 | * | 2/2007 | Dillard et al. | 102/336 |
| 2007/0295236 | A1 | * | 12/2007 | Callaway et al. | 102/336 |
| 2009/0095186 | A1 | * | 4/2009 | Dillard et al. | 102/336 |

* cited by examiner

*Primary Examiner* — Jonathan C Weber
(74) *Attorney, Agent, or Firm* — J. Wiley Horton

(57) ABSTRACT

A tricolor signal flare projectile configured for use with a "high-low" projectile launching system such as the U.S. Army's M-433. The projectile includes a body having a cylindrical side wall and an aft closure. The body's forward portion is open, which provides access to a hollow interior. A delay assembly is installed in the aft closure. The delay assembly includes a delay column. A signal igniter is located just forward of the delay column in the hollow interior of the body. The hollow interior also includes separate volumes of red, white, and blue illuminant. An ogive closes over the top of the hollow interior of the body, thereby encapsulating the other components. When the projectile is fired from a launcher the propellant gases burning with the launcher ignite the delay column. The delay column burns while the projectile travels along its trajectory. After the passage of a desired time interval, the delay column ignites the signal igniter. The signal igniter (1) commences the ignition of the three separate volumes of illuminant; and (2) blows the three separate volumes of illuminant clear of the body.

20 Claims, 8 Drawing Sheets

TRICOLOR FLARE PROJECTILE

CROSS-REFERENCES TO RELATED APPLICATIONS

Not Applicable

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of gas-propelled projectiles. More specifically, the invention comprises an aerial flare projectile providing a tri-color signal.

2. Description of the Related Art

Although the present invention can be configured to operate from a variety of different launchers, it was primarily developed to be fired from launchers adapted to fire 40 mm grenades (such as the U.S. Army's M433). The illustrations provided correspond to this type of launcher, but the reader should bear in mind that the invention could be adapted to many other systems.

Gas-propelled projectiles typically use solid propellant encapsulated in a cartridge case. A projectile is seated in the open mouth of the cartridge case. Ignition of the propellant is provided by percussive or electrical means. The burning propellant generates pressurized gas which forces the projectile out of the mouth of the case and then typically through a barrel bore.

This type of system is used to launch 40 mm grenades. The same approach can be used to launch other types of projectiles as well, including an aerial flare such as is proposed in the present invention. An example of such a projectile is a marker flare. FIG. 1 shows a prior art cartridge case 10 and a projectile assembly 12 of the present invention.

FIG. 2 is a section view through both assemblies. As cartridge case 10 is a prior art item it will be explained in this portion of the disclosure, with the explanation of the projectile occurring later. The cartridge used to launch the projectile is generally referred to as a "high-low" system. High pressure chamber 22 is the "high" component and low pressure chamber 20 is the "low" component.

High pressure chamber 22 contains propellant 16. The propellant is most often contained within a thin-walled vessel which is designed to rupture in a controlled fashion and vent the propellant through one or more vents 18. Primer 14 is detonated typically by a striker—though it can be configured for an electrical initiation. Primer 14 ignites propellant 16.

The burning propellant gases vent into low pressure chamber 20. The reader will observe that cartridge case 10 has an open end. The open end is sealed by seating a desired projectile into the case. The case may then be crimped over a small portion of the projectile in order to create a unified assembly (and thereby create a sealed low pressure chamber 20). The burning propellant gases venting into the low pressure chamber expel the projectile from the case and accelerate it down the bore of the firing weapon.

The nature of a "high-low" projectile launching system is well known in the art and it will therefore not be described in greater detail. However, the reader should be aware that such systems are largely standardized so that a single weapon can launch a wide variety of projectiles—including explosive grenades, marker flares, and star shells. The present invention is a tricolor signal flare which can be deployed using an existing "high-low" system.

BRIEF SUMMARY OF THE INVENTION

The present invention is a tricolor signal flare projectile configured for use with a "high-low" projectile launching system such as the U.S. Army's M-433. The projectile includes a body having a cylindrical side wall and an aft closure. The body's forward portion is open, which provides access to a hollow interior.

A delay assembly is installed in the aft closure. The delay assembly includes a delay column. A signal igniter is located just forward of the delay column in the hollow interior of the body. The hollow interior also includes separate volumes of red, white, and blue illuminant. An ogive closes over the top of the hollow interior of the body, thereby encapsulating the other components.

When the projectile is fired from a launcher the propellant gases burning with the launcher ignite the delay column. The delay column burns while the projectile travels along its trajectory. After the passage of a desired time interval, the delay column ignites the signal igniter. The signal igniter (1) commences the ignition of the three separate volumes of illuminant; and (2) blows the three separate volumes of illuminant clear of the body.

REFERENCE NUMERALS IN THE DRAWINGS

Figure 1:
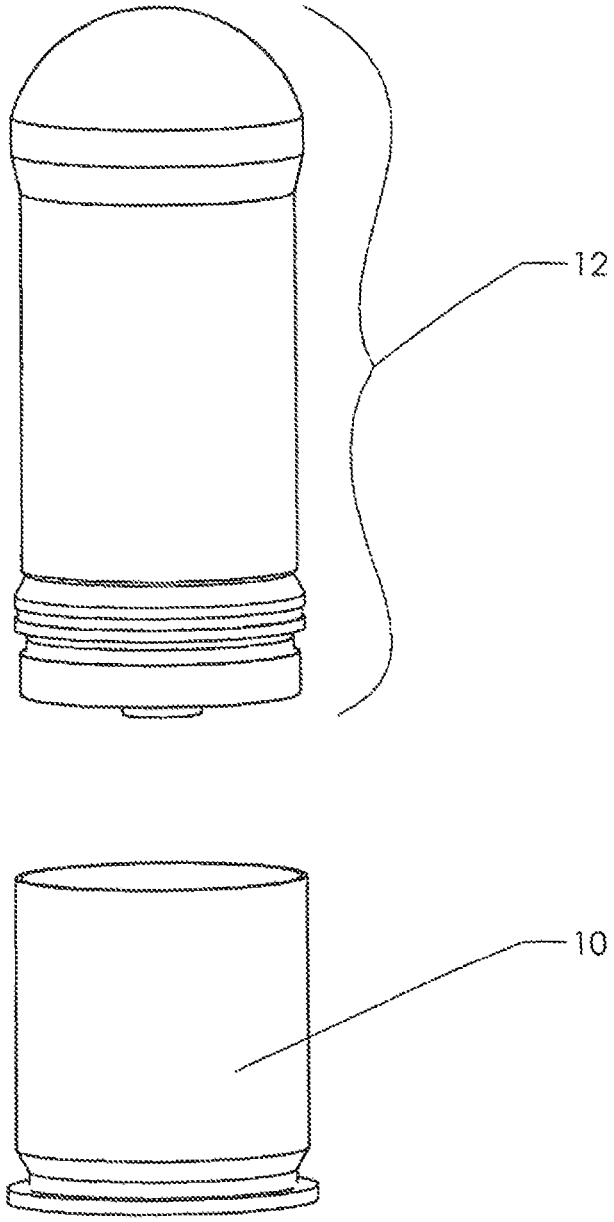
FIG. 1 is an exploded perspective view, showing a projectile assembly separated from the cartridge used to launch it.

| | | | |
|---|---|---|---|
| 10 | cartridge case | 12 | projectile assembly |
| 16 | propellant | 18 | vent |
| 20 | low pressure chamber | 22 | high pressure chamber |
| 24 | body | 26 | aft closure |
| 28 | ogive | 30 | delay assembly |
| 32 | ignition hole | 34 | delay column |
| 36 | signal igniter | 38 | felt spacer |
| 40 | washer | 42 | red illuminant mass |
| 44 | aft sleeve | 46 | white illuminant mass |
| 48 | forward sleeve | 50 | felt spacer |
| 52 | blue illuminant mass | 54 | felt spacer |
| 56 | filler | 58 | central propagation passage |

-continued

| REFERENCE NUMERALS IN THE DRAWINGS | | | |
|---|---|---|---|
| 60 | lateral channel | 62 | opening |
| 66 | cylindrical side wall | | |

DETAILED DESCRIPTION OF THE INVENTION

As discussed previously, FIG. 1 provides a perspective view of projectile assembly 12 separated from prior art cartridge case 10. The cartridge case contains the prior art "high-low" projectile launching system which propels the projectile assembly down the bore of a launching weapon. Exemplary launching weapons include an M203 40 mm under-barrel system, an M79 break-action launcher, an under-barrel MK13, and an M320 convertible under-barrel or stand alone launcher. While the invention is intended primarily for use in such weapon systems, the reader should bear in mind that the invention will function with any suitable launching mechanism and is by no means limited to the existing systems.

Figure 2:
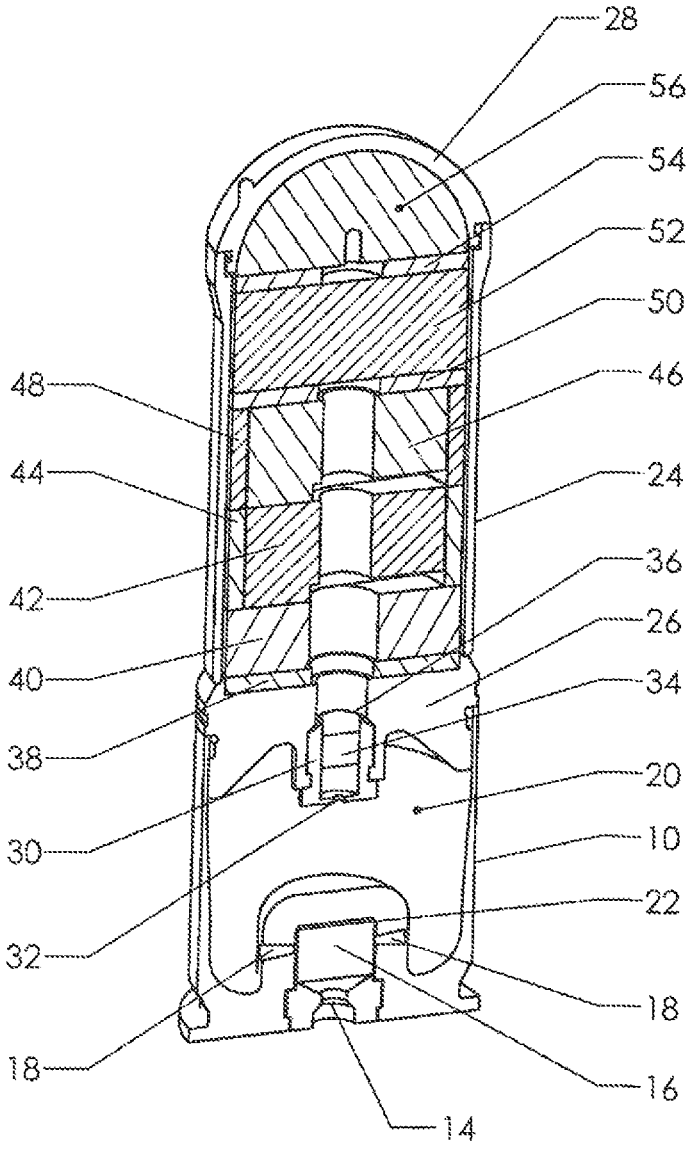
FIG. 2 is a sectional view through the assembly of FIG. 1, showing the projectile and the launching cartridge mated together.

FIG. 2 shows a sectional perspective view through an assembly of the launching cartridge and the projectile. As explained previously, the launching cartridge (when fired) fills low pressure chamber 20 with hot propellant gas. This expanding gas then forces the projectile out of the open end of cartridge case 10 and accelerates it down the bore.

The projectile is enclosed by body 24 and ogive 28. Projectile body 24 includes aft closure 26. A cylindrical side wall extends forward from the aft closure (labeled as cylindrical side wall 66 in FIG. 5). The cylindrical side wall has an open upper end, which is capped by ogive 28.

Returning now to FIG. 2, the reader will observe how the aft closure, the cylindrical side wall, and the ogive combine to create a hollow enclosure within the projectile. This hollow enclosure houses several components. Delay assembly 30 is preferably mounted in the aft portion of the projectile and may in fact be mounted in aft closure 26. The delay assembly contains delay column 34, which is fluidly connected with ignition hole 32. The ignition hole is positioned to deliver hot propellant gas to the delay column when the propelling cartridge is fired.

As those skilled in the art will know, a delay column acts like a fuse. Once ignited it burns for a desired amount of time. This feature allows the projectile to complete a portion of its ballistic trajectory before other components are activated.

Felt spacer 38 is located immediately forward of the forward portion of aft closure 26. Signal igniter 36 is preferably located in the middle of felt spacer 38. Once the delay column finishes its "fuse" function it ignites signal igniter 36. It is preferable to provide direct fluid communication between the signal igniter and the other components which need to be ignited. A central propagation passage (labeled as "58" in FIG. 5) is provided for this purpose. Several components include a cavity which comprises this central propagation passage.

Returning to FIG. 2, the reader will observe that washer 40 is provided directly in front of felt spacer 38. Washer 40 includes a through-hole located directly in front of signal igniter 36. This through-hole forms the first part of the central propagation passage.

The projectile contains three illuminant masses producing three different colors. Red illuminant mass 42 is located just forward of washer 40. As the name implies, in the embodiment shown this mass produces a bright red light when it is ignited. Preferably before the assembly of the projectile, the red illuminant mass is pressed into aft sleeve 44 to form an integral red illuminant assembly. The aft sleeve provides structural integrity during the launch of the projectile and the eventual ejection of the illuminant assemblies. The reader will note that the red illuminant assembly contains a hole through its center which forms part of the central propagation passage.

White illuminant mass 46 is located just forward of the red illuminant assembly. As for the red illuminant assembly, the white illuminant is pressed into forward sleeve 48 to create an integral white illuminant assembly. The white illuminant assembly produces a bright white light when ignited. It also contains a hole through its center which forms part of the central propagation passage.

It is preferable for the various components to fit fairly tightly within the projectile's interior. For example, felt spacers 50 and 54 may be provided to maintain appropriate longitudinal compression. Felt spacer 50 includes a central hole which completes the forward extreme of the central propagation passage. Immediately forward of felt spacer 50 is blue illuminant mass 52. This is a solid mass of material which produces a bright blue light when ignited. Felt spacer 54 lies forward of blue illuminant mass 52.

Ogive 28 preferably snaps into the open top of the projectile body 24—thereby producing a sealed interior. It is designed to be blown free of the projectile body when suitable internal pressure is created. The particular details of the fit between the ogive and the projectile body are not material to the present invention. Any suitable connection may be used, so long as the two components separate when the signal flare is ignited.

Figure 3:
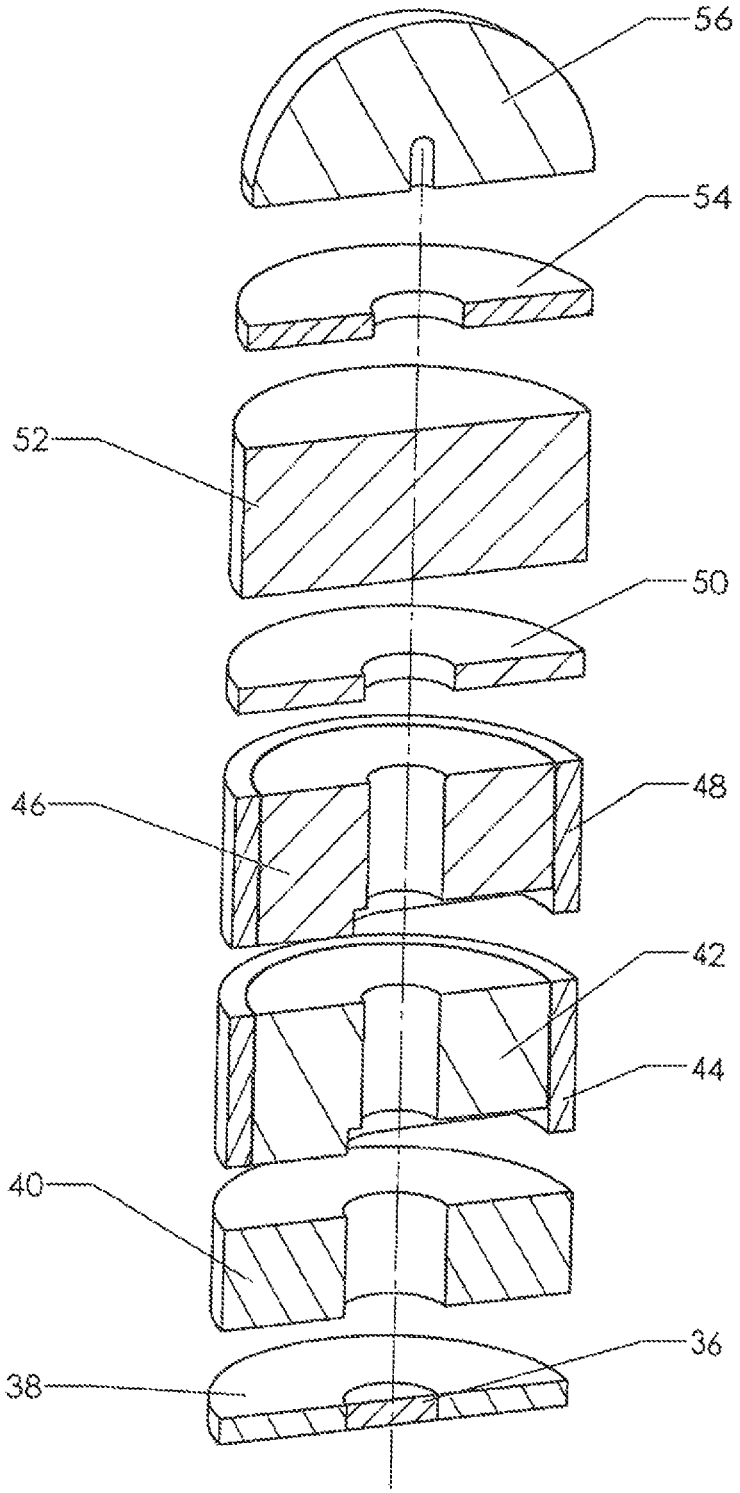
FIG. 3 is an exploded sectional view, showing some of the components contained within the projectile assembly.

FIG. 3 shows the internal components removed from the projectile body so that they may be more easily visualized. The components are shown sectioned in half. Filler 56 may be provided inside the ogive to maintain the desired level of longitudinal compression. In other embodiments it may be omitted.

Figure 4:
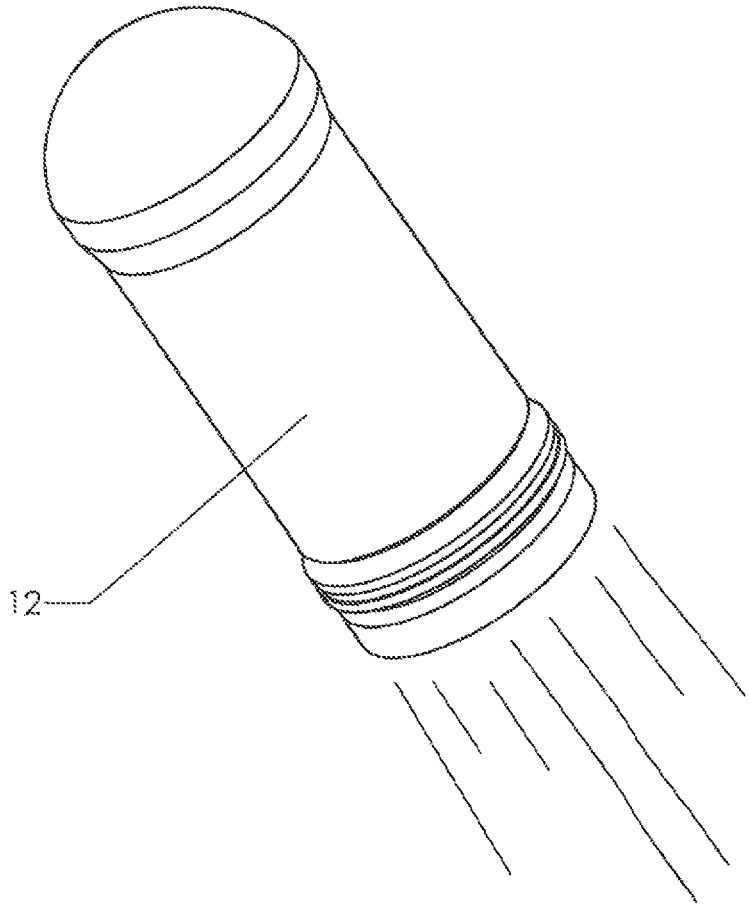
FIG. 4 is a perspective view, showing the projectile assembly in flight.

FIG. 4 shows the complete projectile assembly 12 in flight. The invention appears in this configuration while the delay column is burning but before the time it has ignited the other internal components.

Figure 5:
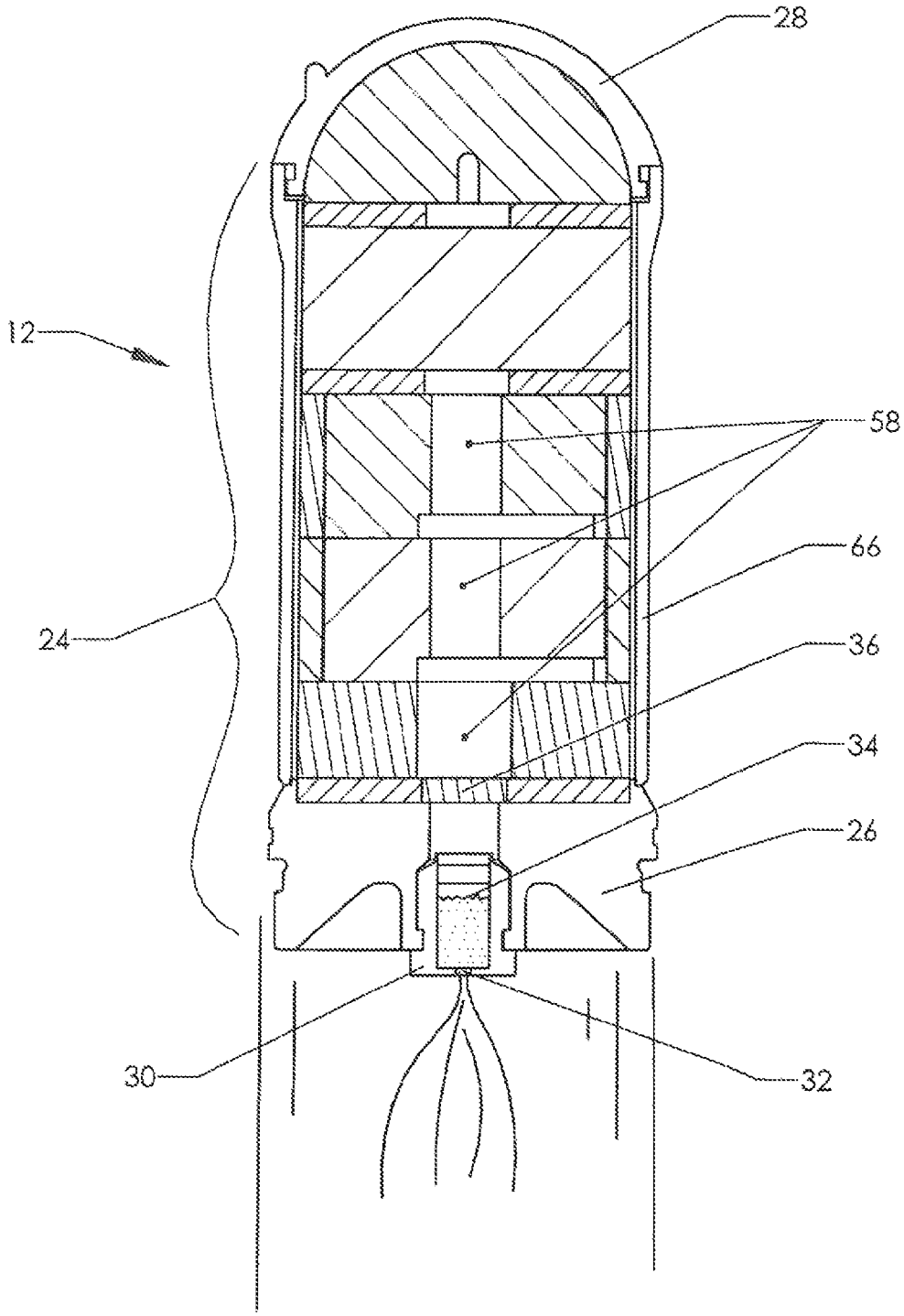
FIG. 5 is a sectional elevation view, showing the operation of the delay assembly.
Figure 6:
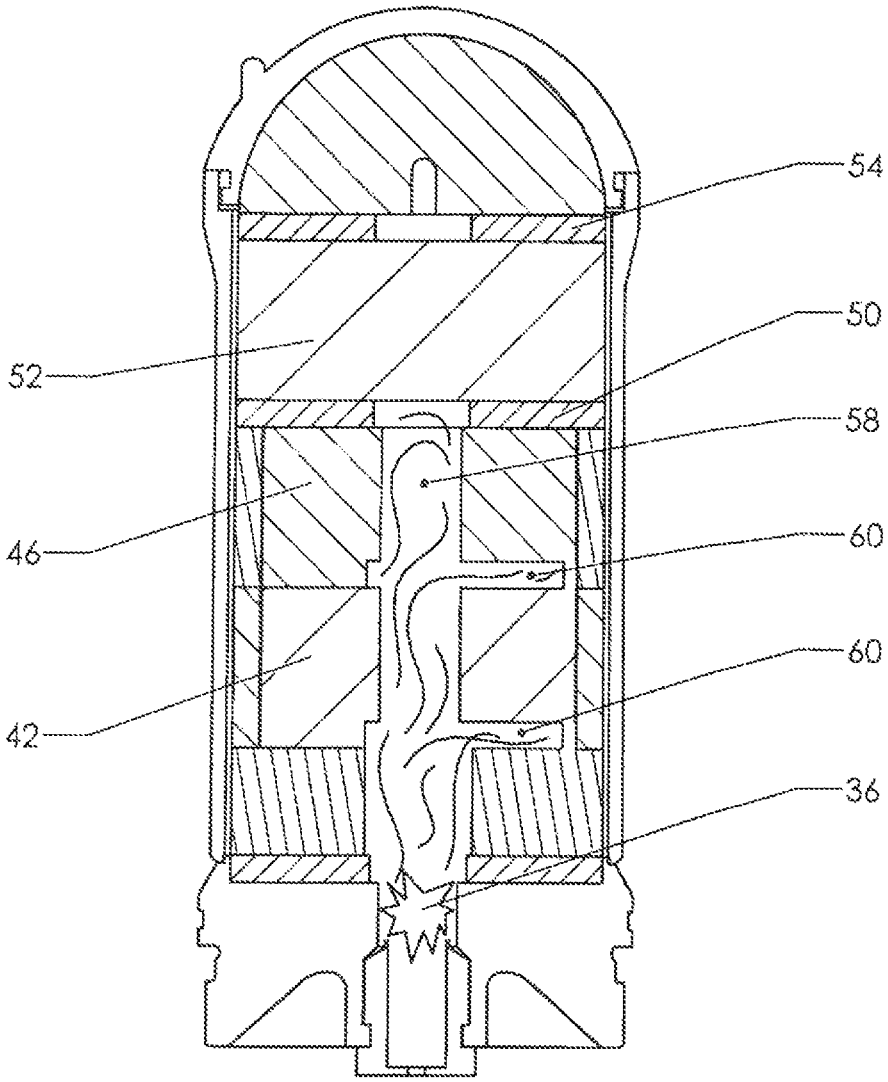
FIG. 6 is a sectional elevation view, showing the ignition of the illuminant material and the build-up of pressure inside the body of the projectile.
Figure 7:
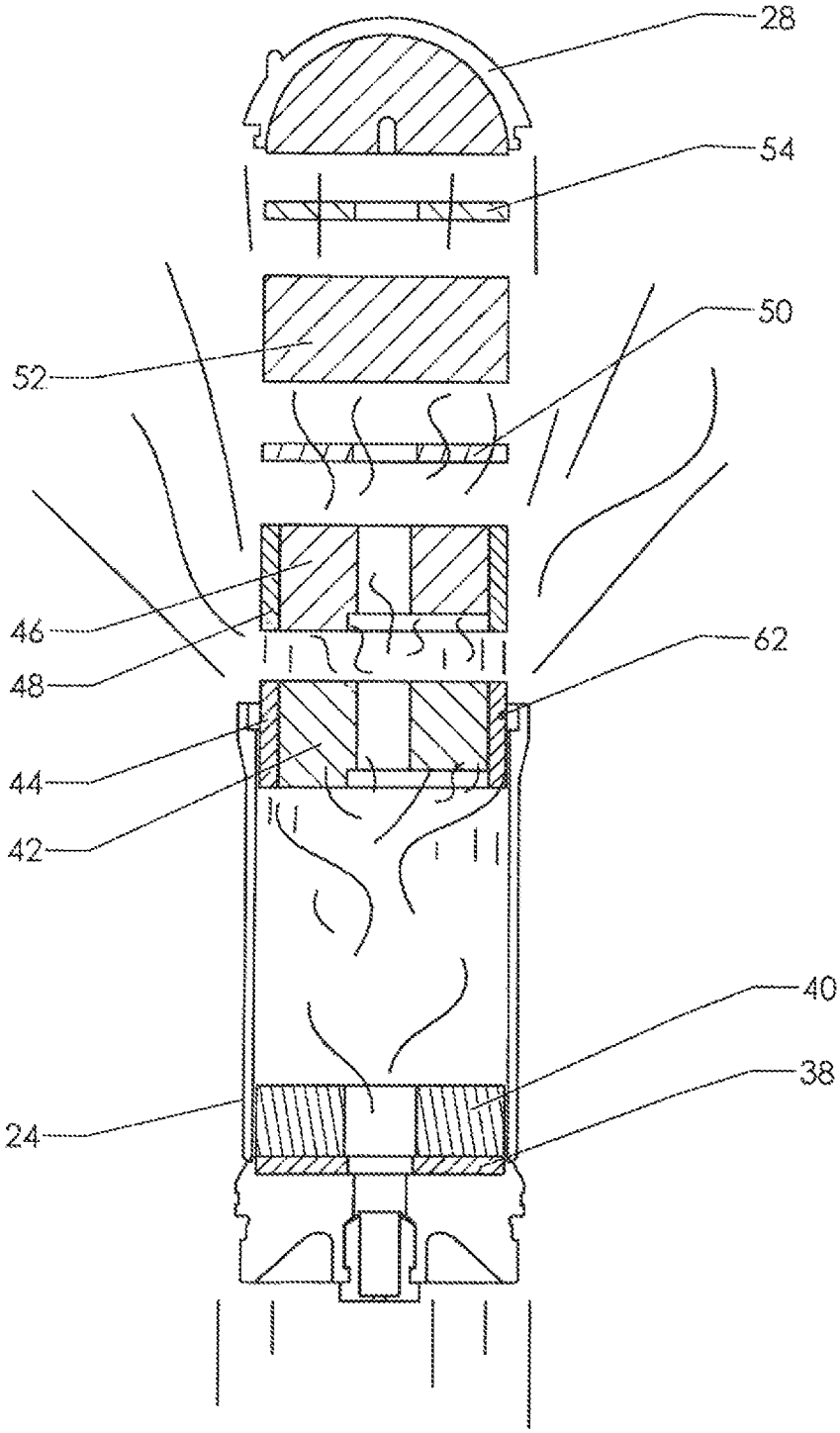
FIG. 7 is a sectional elevation view, showing the expulsion of the burning volumes of illuminant from the projectile body.

FIGS. 5-7 illustrate the delay feature and ignition of the signal flare. In FIG. 5, projectile assembly has been launched from the launching device. The hot propellant gas generated by the launching device passes through ignition hole 32 and ignites delay column 34. The delay column is shown burning forward as the projectile flies. When the combustion front reaches the forward portion of the delay column, it ignites signal igniter 36.

FIG. 6 shows the projectile assembly after the ignition of signal igniter 36. Burning gas from the signal igniter propagates forward through central propagation passage 58. Lateral channels 60 are preferably added to enhance the ignition of one or more of the illuminant assemblies.

Figure 8:
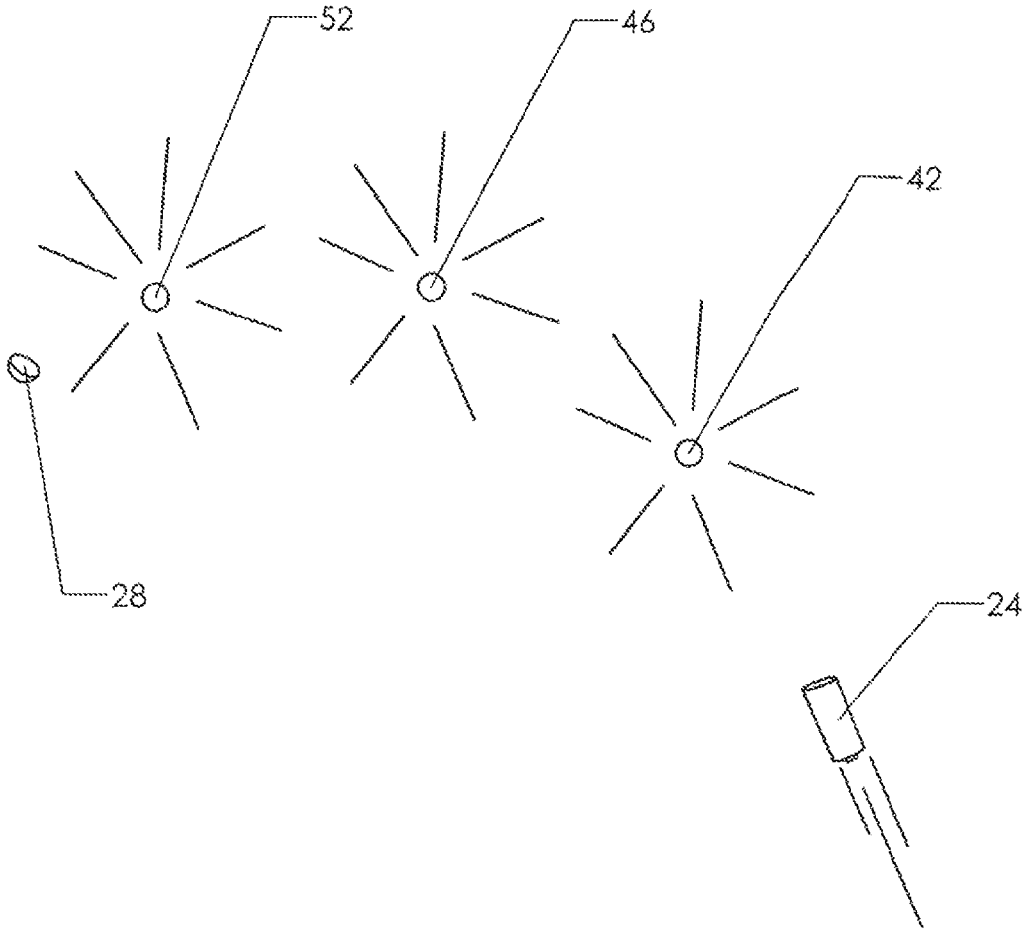
FIG. 8 is a perspective view, showing the deployment of the signal flares.

At the stage shown in FIG. 6, internal pressure within the hollow interior of the projectile body is building. Once the illuminant material is ignited, an additional and substantial volume of expanding gas is created. FIG. 7 shows this stage. Ogive 28 has been dislodged from opening 62 and blown clear. The internal pressure causes the burning illuminant assemblies to be thrown clear as well. The result is shown in FIG. 8. Three burning masses of illuminant have been thrown clear of projectile body 24 and ogive 28. The burning masses may then easily be seen.

In the embodiment described, the signal flare is a red-white-blue signal. The illuminant masses are preferably configured so that they separate enough to allow the three separate colors to be individually seen. However, they should remain fairly close together so that a viewer will perceive the tricolor signal as being from a single source.

The choice of colors for the illuminant masses used may be varied as desired. As one example, the white illuminant might be placed aft with the red illuminant in the middle. As a second variation a particular user might select a red-white-green signal. Those skilled in the art will also realize that the propagation passage 58 and lateral channels 60 could be varied considerably while achieving the same result.

The particular structure of the projectile body could also be varied. FIG. 5 shows an embodiment in which cylindrical side wall 66 and aft closure 26 are made as one integral piece. This unit could also be made as two separate pieces joined together. Another option would be to form ogive 28 and cylindrical side wall 66 as one integral piece, with aft closure 26 being a separate piece. The burning illuminants would then be ejected via blowing the aft closure free rather than the ogive.

Details Regarding the Illuminant Compositions:

The reader may wish to know the chemical composition of the illuminants employed in the preferred embodiments. Each illuminant composition will generally contain a mixture of fuel, oxidizer, colorant, and binder. Mass fractions will be given for each. In the case of the illuminant composition for the blue portion of the flare, the preferred ingredients (stated on the basis of percentage of weight) are as follows:

TABLE ONE

| BLUE ILLUMINANT | |
|---|---|
| INGREDIENT | PERCENTAGE BY WEIGHT |
| POTASSIUM PERCHLORATE | 30-50% |
| BLACK COPPER OXIDE | 10-30% |
| RED GUM | 1-10% |
| DEXTRIN | 1-10% |
| CHLORINATED RUBBER | 10-20% |
| MAGNALIUM | 1-10% |
| BINDER | 5-10% |

In this composition the oxidizer is potassium perchlorate. The colorant is the black copper oxide (which provides the copper). The fuel composition is the mixture of red gum, dextrin, chlorinated rubber, and magnalium. Although these materials are well known to those skilled in the art, some additional explanation of their function will be helpful in understanding possible substitutions of other similar materials.

Potassium perchlorate is a well-known oxidizer in the field of pyrotechnics. Many other common oxidizers could be substituted, including potassium chlorate and ammonium perchlorate.

Other copper sources could be substituted for the black copper oxide, including copper carbonate, copper oxychloride, copper (I) chloride, and Paris Green (copper (II) acetoarsenite). There are other copper salts which could be used as well.

Red gum is well known in the pyrotechnics field and is also known as accroides resin. Dextrin is a mixture of low molecular weight carbohydrates having the general formula $(C_6H_{10}O_5)_n$. Magnalium is an alloy of aluminum and magnesium. In the preferred embodiment the magnesium to aluminum ratio is about 65% to 35% by mass.

The binder shown in the preceding table is itself a mixture of ingredients. The following table presents ranges for the preferred embodiments of the binder:

TABLE TWO

| BLUE ILLUMINANT BINDER | |
|---|---|
| INGREDIENT | PERCENTAGE BY WEIGHT |
| LAMINAC | 90-99% |
| LUPERSOL | 1-5% |
| COBALT NAPTHENATE | 0-15% |

Laminae is a commonly used thermoset polyester. Lupersol is a catalyst which is mixed into the polyester resin. Cobalt napthenate is a mixture of cobalt (II) derivatives of napthenic acids. There are a large number of other potential binder systems, including polyvinyl acetate, nitrocellulose, and linseed oil.

The illuminant composition for the white portion of the flare can likewise be created with a wide variety of ingredients. The following represents the ranges for the preferred embodiments, stated as a percentage of weight:

TABLE THREE

| WHITE ILLUMINANT | |
|---|---|
| INGREDIENT | PERCENTAGE BY WEIGHT |
| POTASSIUM NITRATE | 45-65% |
| MAG POWDER TYPE IV MIL-P-14067B | 10-20% |
| MAG POWDER MIL-P-14067 | 20-30% |
| BINDER | 1-10% |

The potassium nitrate of course serves as the oxidizer. Other common oxidizers which could be substituted include sodium nitrate, potassium chlorate, and potassium perchlorate. The magnesium powder serves as the fuel. One could also substitute one or more of the following: aluminum, magnalium, lactose, red gum, and polyvinyl chloride (any of which would produce a white burning flare). The binder compositions are the same as those discussed with respect to the blue illuminant.

The illuminant composition for preferred embodiment of the red part of the flare is presented in the following table, stated as a percentage by weight:

TABLE FOUR

| RED ILLUMINANT | |
|---|---|
| INGREDIENT | PERCENTAGE BY WEIGHT |
| STRONTIUM NITRATE | 35-65% |
| POLYVINYL CHLORIDE | 5-20% |
| MAGNESIUM POWDER 50/100 | 20-30% |
| BINDER | 1-10% |

The strontium nitrate serves as an oxidizer and—in combination with the fuel selected—produces the desired flame color. Other strontium salts could be substituted, such as strontium perchlorate or strontium chloride. The PVC and the magnesium powder serve as fuel. Other fuels could be substituted, such as aluminum, magnalium, red gum, or lactose. The binder composition for the red illuminant is the same as that used in the blue illuminant.

The reader will therefore appreciate that the present invention provides a signal flare which simultaneously deploys three distinct colors. Although the preceding description contains significant detail, it should not be construed as limiting the scope of the invention but rather as providing illustrations of the preferred embodiments of the invention. As one example, the ordering of the colors within the stack of illuminant assemblies could be altered as desired. Thus, the scope of the invention should be fixed by the following claims, rather than by the examples given.

Having described our invention, we claim:

1. A signal flare projectile system, comprising:

a. a launching cartridge, said launching cartridge including, i. a mass of propellant in a high pressure chamber, ii. a low pressure chamber, said low pressure chamber having an open forward end, iii. at least one vent connecting said high pressure chamber to said low pressure chamber;

b. a projectile body, said body including, i. an aft closure, with said aft closure being seated in said open forward end of said low pressure chamber of said launching cartridge, ii. a cylindrical side wall extending forward from said aft closure and defining a hollow interior with an open forward end;

c. a delay assembly mounted in said aft closure, with said delay assembly including, i. a delay column, having a forward end and an of end, ii. an ignition hole positioned to ignite said aft end of said delay column using combustion gases within said low pressure chamber;

d. a signal igniter, positioned proximate said forward end of said delay column;

e. a first illuminant mass having a first burning color, said first illuminant mass being located within said hollow interior of said projectile body forward of said signal igniter;

f. a second illuminant mass having a second burning color which is different from said first burning color, said second illuminant mass being located within said hollow interior of said projectile had forward of said first illuminant mass;

g. a third illuminant mass having a third burning color which is different from said first and second burning colors, said third illuminant mass being located within said hollow interior of said projectile body forward of said second illuminant mass;

h. an ogive connected to said projectile body and lying forward of said third illuminant mass, with said ogive sealing said open forward end of said projectile body; and i. a propagation passage through said first and second illuminant masses, said propagation passage being in communication with said third illuminant mass and with said signal igniter so that hot gasses produced by said signal igniter will ignite said first, second, and third illuminant masses.

2. A signal flare projectile system as recited in claim 1, wherein said ogive is snapped into said open forward end of said projectile body so that pressure within said projectile body blows said ogive free of said open forward end.

3. A signal flare projectile system as recited in claim 2, wherein said first, second, and third illuminant masses are shaped so that pressure created by the ignition of said signal igniter will blow them out said open forward end of said projectile body.

4. A signal flare projectile system as recited claim 1, wherein said first illuminant mass produces a red light upon ignition, said second illuminant mass produces a white light upon ignition, and said third illuminant mass produces a blue light upon ignition.

5. A signal flare projectile system as recited in claim 4, wherein said propagation passage opens into a first lateral passage between said first and second illuminant masses and wherein said propagation passage opens into a second lateral passage between said second and third illuminant masses.

6. A signal flare projectile system as recited in claim 1, further comprising:

a. a sleeve between said first illuminant mass and said cylindrical side wall of said projectile body; and b. a sleeve between said second illuminant mass and said cylindrical side wall of said projectile body.

7. A signal flare projectile system as recited in claim 1, wherein said aft closure and said cylindrical side wall of said projectile body are formed as one integral piece.

8. A signal flare projectile system, comprising:

a. a launching cartridge having an open forward end and a source of hot propellant gas;

b. a projectile body, including, i. a closed aft end, ii. a cylindrical side wall extending forward from said closed aft end to form a hollow interior with an open forward end;

c. a delay assembly mounted in said projectile body, with said delay assembly including a delay column connected to an ignition hole, with said ignition hole being positioned to be in communication with said source of hot propellant gas in said launching cartridge;

d. a signal igniter, positioned to be ignited by said delay column;

e. a first illuminant mass having a first burning color, said first illuminant mass being located within said hollow interior of said projectile body proximate said signal igniter;

f. a second illuminant mass having a second burning color which is different from said first burning color, said second illuminant mass being located within said hollow interior of said projectile body forward of said first illuminant mass;

g. a third illuminant mass having a third burning color which is different from said first and second burning colors, said third illuminant mass being located within said hollow interior of said projectile body forward of said second illuminant mass;

h. an ogive connected to said projectile body and lying forward of said third illuminant mass, with said ogive sealing said open forward end of said projectile body; and i. a propagation passage through said first and second illuminant masses, said central propagation passage being in communication with said third illuminant mass and with said signal igniter so that hot gasses produced by said signal igniter will ignite said first, second, and third illuminant masses.

9. A signal flare projectile system as recited in claim 8, wherein said ogive is snapped into said open forward end of said projectile body so that pressure within said projectile body blows said ogive free of said open forward end.

10. A signal flare projectile system as recited in claim 9, wherein said first, second, and third illuminant masses are shaped so that pressure created by the ignition of said signal igniter will blow them out said open forward end of said projectile body.

11. A signal flare projectile system as recited in claim 8, wherein said propagation passage assumes the form of a hollow cylinder passing through said first illuminant mass and said second illuminant mass.

12. A signal flare projectile system as recited in claim 11, wherein said propagation passage opens into a first lateral passage between said first and second illuminant masses and wherein said propagation passage opens into a second lateral passage between said second and third illuminant masses.

13. A signal flare projectile system as recited in claim 8, further comprising:

a. a sleeve between said first illuminant mass and said cylindrical side wall of said projectile body; and b. a sleeve between said second illuminant mass and said cylindrical side wall of said projectile body.

14. A signal flare projectile system as recited in claim 8, wherein said aft closure and said cylindrical side wall of said projectile body are formed as one integral piece.

15. A signal flare projectile system, comprising:

a. a launching cartridge having an open forward end and a source of hot propellant gas;

b. a projectile body, including, i. an at closure, ii. a cylindrical side wall extending forward from said aft closure to form a hollow interior with an open forward end;

c. a delay assembly mounted in said aft closure, with said delay assembly including a delay column connected to an ignition hole, with said ignition hole facing aft and being positioned to be in communication with said source of hot propellant gas in said launching cartridge;

d. a signal igniter, positioned to be ignited by said delay column;

e. a first illuminant mass having a first burning color, said first illuminant mass being located within said hollow interior of said projectile body forward of said signal igniter;

f. a second illuminant mass having a second burning color which is different from said first burning color, said second illuminant mass being located within said hollow interior of said projectile body forward of said first illuminant mass;

g. a third illuminant mass having a third burning color which is different from said first and second burning colors, said third illuminant mass being located within said hollow interior of said projectile body forward of said second illuminant mass;

h. an ogive connected to said projectile body and lying forward of said third illuminant mass, with said ogive sealing said open forward end of said projectile body; and i. a propagation passage through said first and second illuminant masses, said central propagation passage being in communication with said third illuminant mass and with said signal igniter so that hot gasses produced by said signal igniter will ignite said first, second, and third illuminant masses.

16. A signal flare projectile system as recited in claim 15, wherein said ogive is snapped into said open forward end of said projectile body so that pressure within said projectile body blows said ogive free of said open forward end.

17. A signal flare projectile system as recited in claim 16, wherein said first, second, and third illuminant masses are shaped so that pressure created by the ignition of said signal igniter will blow them out said open forward end of said projectile body.

18. A signal flare projectile system as recited in claim 15, wherein said propagation passage assumes the form of a hollow cylinder passing through said first illuminant mass and said second illuminant mass.

19. A signal flare projectile system as recited in claim 18, wherein said propagation passage opens into a first lateral passage between said first and second illuminant masses and wherein said propagation passage opens into a second lateral passage between said second and third illuminant masses.

20. A signal flare projectile system as recited in claim 15, further comprising:

a. a sleeve between said first illuminant mass and said cylindrical side wall of said projectile body; and b. a sleeve between said second illuminant mass and said cylindrical side wall of said projectile body.

* * * * *